US006103102A

United States Patent [19]

Hatanaka et al.

[11] Patent Number: 6,103,102

[45] Date of Patent: Aug. 15, 2000

[54] METHOD FOR IMPROVING THE YIELD OF LIGHTER COMPONENTS IN HEAT-REFINING PROCESS OF PETROLEUM HEAVY OIL, AND ADDITIVE USED IN THE METHOD

[75] Inventors: Toshifumi Hatanaka, Kyoto; Kazuya Hata, Tokyo; Tetsushi Kawamura, Tokyo; Hirokazu Itoh, Hyogo; Yoshihiro Arita, Osaka, all of Japan

[73] Assignees: Nippon Shokubai Co., Ltd., Osaka, Japan; ELF Atochem S.A., Puteauz, France

[21] Appl. No.: 08/883,702

[22] Filed: Jun. 27, 1997

[30] Foreign Application Priority Data

Jun. 28, 1996 [JP] Japan ..... 8-188257

[51] Int. Cl.[7] ..... C10G 9/26; C10G 9/12

[52] U.S. Cl. ..... 208/125; 208/48 R; 208/48 AA

[58] Field of Search ..... 208/48, 48 AA, 208/125

[56] References Cited

U.S. PATENT DOCUMENTS 4,566,878 1/1986 Karol et al. ..... 44/57

4,587,007 5/1986 Rudnick .

FOREIGN PATENT DOCUMENTS 0 290 624 11/1988 European Pat. Off. .

0816475A2 1/1998 European Pat. Off. ..... C10G 75/04

62-207394 9/1977 Japan .

62-190285 8/1987 Japan .

OTHER PUBLICATIONS

Australian Search Report dated Nov. 6, 1998 International Search Report dated Feb. 22, 1988.

*Primary Examiner*—Helane E. Myers

*Attorney, Agent, or Firm*—Smith Gambrell & Russell, LLP

[57] ABSTRACT

Method for improving the yield of lighter components in heat-refining process of petroleum heavy oil, and additive used in the method. The heat-treatment in a heating unit is effected in the presence of at least one compound (I) having at least one mercapto alkylthio group: HS—$C_mH_{2m}$—S—, in which "m" is an integer of 2 to 4.

6 Claims, 1 Drawing Sheet

METHOD FOR IMPROVING THE YIELD OF LIGHTER COMPONENTS IN HEAT-REFINING PROCESS OF PETROLEUM HEAVY OIL, AND ADDITIVE USED IN THE METHOD

BACKGROUND OF THE INVENTION

1. Field of the Invention

This invention relates to an improvement in oil refining process. In particular, this invention relates to a method to improve remarkably the yield of lighter components in a refining process of heavy oils without any necessity to change details of the existing oil refinery plants.

This invention relates also to an additive for increasing the yield of lighter components in the oil refinery process.

This invention also relates to a novel use of a compound (I) having at least one mercaprtoalkylthio group: HS—$C_mH_{2m}$—S—, in which "m" is an integer of 2 to 4.

2. Description of Related Art

One of objects of oil refinery is to increase the yield of lighter components such as kerosene and gas oil which are much value added products comparing to heavier components which are less value added products. In fact, in actual oil refinery processes, heavier components such as residual oil from atmospheric distillation column is heat-treated in vacuum distillation column, thermal cracking unit or visbreaking unit to obtain lighter components. These processes and apparatuses are well-known and are described in many books, for example "World Encyclopedia" 13, Heibon-sha, 1966, p 237–254.

The yield of lighter components can be increased by elevating operation temperature in the heating units. However, elevation of operation temperature in the heating units cause a trouble of increment of cokes which deposit on inner walls of heating unit or heat-exchangers, resulting in frequent stop of production plants for maintenance. In particular, in a case of thermal cracking process of heavy oil, heating tubes in a heating furnace are seriously contaminated and are choked with deposited cokes, so that production plant can not be operated continuously for longer time but must be stopped frequently for cleaning.

Due to this problem, actual oil refinery plants are compelled to be operated at relatively lower operation temperature than such ideal operation temperature that assure higher yield of lighter components. In other words, operation temperature can not be elevated above certain limit.

Inventors found, surprisingly, such a fact that the yield of lighter components can be increased remarkably by incorporating an additive having specific mercapto alkylthio group in material of heavy oil to be refined in heating units used in a variety of oil refining processes, and completed the invention.

SUMMARY OF THE INVENTION

The present invention provides a method for improving the yield of lighter components in heat-refining process of petroleum heavy oil, characterized in that the heat-treatment in a heating unit is effected in the presence of at least one compound (I) having at least one mercapto alkylthio group:

$$HS—C_mH_{2m}—S—$$

in which "m" is an integer of 2 to 4.

The present invention provides also an additive to improve the yield of lighter components in heat-refining process of petroleum heavy oil, comprising at least one of the compound (I).

The compound (I) having mercapto alkylthio group can be added to a material of heavy oil before the material is introduced into the heating unit. Timing of addition is not specially limited but the compound (I) is added to the material usually near to an inlet of the heating unit. Mixing of the compound (I) with the material is not necessary. In a variation, the compound (I) and the material of heavy oil may be introduced directly and separately into a heating unit.

The compound (I) having mercapto alkylthio group is added at a proportion of 10 ppm to 1% by weight, preferably 50 ppm to 0.5% by weight, more preferably 100 ppm to 0,1% by weight with respect to heavy oil to be treated. No advantage of the present invention is expected below the lower limit of 10 ppm. Higher proportion above 1% by weight is not excluded but is included in the scope of the present invention. However, excess use of the compound (I) above the upper limit do not improve advantages of the present invention and is not preferable.

The method according to the present invention is advantageously applicable to an operation temperature between 250° C. and 550° C., preferably between 350° C. and 550° C. Operation temperatures of higher than 550° C. and lower than 250° C. are not excluded in the present invention. However, when the operation temperature becomes lower than 250° C., petroleum hydrocarbons can not be decomposed and hence advantages of the present invention is not remarkable On the contrary, if the operation temperature exceeds 550° C., decomposition of petroleum hydrocarbons proceed rapidly regardless of presence or absence of the compounds (I) according to the present invention and hence advantages of the present invention can not be recognized.

Residence time of the compound (I) having mercapto alkylthio group in a heating unit is not specially limited. Usually, the compound (I) having mercapto alkylthio group carried into and then flown out the heating unit together with the material of heavy oil. In fact, in a case that the heating unit is a distillation column, the compound (I) removes the distillation column together with a cut or cuts each withdrawn at predetermined stage between the top and the bottom of the column. Therefore, the residence time of the compound (I) having mercapto alkylthio group according to the present invention in a heating unit is equal to the residence time of the material of heavy oils in oil refinery process, and is usually between 1 to 60 minutes, preferably 10 to 30 minutes.

The heating unit which is used in the present invention can be any one that are used in the conventional oil refinery process such as atmospheric distillation column, vacuum distillation column, thermal cracking unit and visbreaking unit.

The heavy oils to which the present invention is applied is not specially limited but the present invention is advantageously applicable to heavy components whose problem of coke deposition is serious, such as residue of atmospheric distillation column.

The compound (I) having mercapto alkylthio group used in the present invention is understood as a compound having at least one mercaprtoalkylthio group: HS—$C_mH_{2m}$—S— in which mercapto group (HS) and sulfur atom (S) are spaced by an alkylene group ($C_mH_{2m}$) having carbon number of 2 to 4, namely "m" is an integer of 2 to 4. The alkylene group ($C_mH_{2m}$) can be linear chain or branched chain.

The method according to the present invention is advantageously applicable to those having the mercaprtoalkylthio group whose "is" is 2 or 3.

In the method according to the present invention, the compound (I) having mercapto alkylthio group can be used in a form of a mixture or combination.

The compound (I) having mercapto alkylthio group may be compounds represented by the general formula (A):

$$(R_1, R_2, R_3, R_4, R_5, R_6)\text{-}(S\text{—}C_mH_{2m}\text{—}SH)_n \quad (A)$$

in which

"m" is an integer of 2 to 4,

"n" is an integer of 1 to 6, and each of $R_1$, $R_2$, $R_3$, $R_4$, $R_5$ and $R_6$ is organic group and may be bonded each other through one or more than one chemical bonds, and at least one of $R_1$, $R_2$, $R_3$, $R_4$, $R_5$ and $R_6$ must exist in said compound, the total carbon number of $R_1$, $R_2$, $R_3$, $R_4$, $R_5$ and $R_6$ being 2 to 28.

Followings are examples of the compound (I) having mercapto alkylthio group used in the present invention:

$HSCH_2CH_2SCH_2CH_2SH$ $HSCH_2CH_2SCH_2CH_2SCH_2CH_2SH$ $HOCH_2CH_2SCH_2CH_2SH$ $HO(CH_2CH_2S)_x H$ (in which "x" is an integer equal to 3 or higer than 3)

$HO(CH_2CH(CH_3)S)_x H$ (in which "x" is an integer equal to 2 or of higer than 2)

$CH_3SCH_2CH_2SH$ $CH_3SCH_2CH_2SCH_2CH_2SH$ $CH_3CH_2CH_2CH_2SCH_2CH_2SH$ $CH_3SCH_2CH(CH_3)SH$ $CH_3CH_2CH_2CH_2SCH_2CH(CH_3)SH$ $C_6H_5SCH_2CH_2SH$ $C_6H_5SCH_2CH(CH_3)SH$ $CH_3OCOCH_2SCH_2CH_2SH$ $CH_3OCOCH_2SCH_2CH_2SCH_2CH_2SH$ $CH_3OCOCH_2SCH_2CH(CH_3)SH$ $CH_3OCOCH_2SCH_2C(CH_3)_2SH$ $C_8H_{17}OCOCH_2SCH_2CH_2SH$ $CH_3OCOCH_2CH_2SCH_2CH_2SH$ $CH_3OCOCH_2CH_2SCH_2CH_2SCH_2CH_2SH$ $CH_3OCOCH_2CH_2SCH_2CH(CH_3)SH$ $CH_3OCOCH_2CH_2SCH_2CH_2CH_2SH$ $(HSCH_2COOCH_2)_3C(CH_2OCOCH_2SCH_2CH_2SH)$ $(HSCH_2COOCH_2)_2C(CH_2OCOCH_2SCH_2CH_2SH)_2$ $(HSCH_2COOCH_2)C(CH_2OCOCH_2SCH_2CH_2SH)_3$ $C(CH_2OCOCH_2SCH_2CH_2SH)_4$ $(HSCH_2CH_2COOCH_2)_3C(CH_2OCOCH_2CH_2SCH_2CH_2SH)$ $(HSCH_2CH_2COOCH_2)_2C(CH_2OCOCH_2CH_2SCH_2CH_2SH)_2$ $(HSCH_2CH_2COOCH_2)C(CH_2OCOCH_2CH_2SCH_2CH_2SH)_3$ $C(CH_2OCOCH_2CH_2SCH_2CH_2SH)_4$ $(HOCH_2)_3C(CH_2OCOCH_2CH_2SCH_2CH_2SH)$ $(HOCH_2)_2C(CH_2OCOCH_2CH_2SCH_2CH_2SH)_2$ $(HOCH_2)C(CH_2OCOCH_2CH_2SCH_2CH_2SH)_3$ $(HSCH_2CH_2COOCH_2)_2C(C_2H_5)(CH_2OCOCH_2CH_2SCH_2CH_2SH)$ $(HSCH_2CH_2COOCH_2)\ C(C_2H_2)(CH_2OCOCH_2CH_2SCH_2CH_2SH)_2$ $C_2H_5C(CH_2OCOCH_2CH_2SCH_2CH_2SH)_3$ $(HOCH_2)_3CCH_2O\text{—}CH_2C(CH_2OH)_2(CH_2OCOCH_2CH_2SCH_2CH_2SH)$ $(HSCH_2CH_2SCH_2CH_2COOCH_2)(CH_2OH)_2CCH_2\text{—}O\text{—}CH_2C(CH_2OH)_2(CH_2OCOCH_2CH_2SCH_2CH_2SH)$ $(HSCH_2CH_2SCH_2CH_2COOCH_2)(CH_2OH)_2CCH_2\text{—}O\text{—}CH_2C(CH_2OH)(CH_2OCOCH_2CH_2SCH_2CH_2SH)_2$ $(HSCH_2CH_2SCH_2CH_2COOCH_2)_2(CH_2OH)CCH_2\text{—}O\text{—}CH_2C(CH_2OH)(CH_2OCOCH_2CH_2SCH_2CH_2SH)_2$ $(HSCH_2CH_2SCH_2CH_2COOCH_2)_2(CH_2OH)CCH_2\text{—}O\text{—}CH_2C(CH_2OCOCH_2CH_2SCH_2CH_2SH)_3$ $(HSCH_2CH_2SCH_2CH_2COOCH_2)_3CCH_2\text{—}O\text{—}CH_2C(CH_2OCOCH_2CH_2SCH_2CH_2SH)_3$ $CH_3OCOCH_2SCH_2CH(CH_3)SCH_2CH(CH_3)SH$ $CH_3OCOCH_2CH_2SCH_2CH(CH_3)SCH_2CH(CH_3)SH$ It is true that the compound (I) having mercapto alkylthio group used in the present invention functions as an inhibitor to prevent deposition of cokes and improve the yield but inventors can not explain the reason theoretically.

Now, examples of the present invention will be explained but the present invention is not limited to following illustrative examples.

Figure 1:
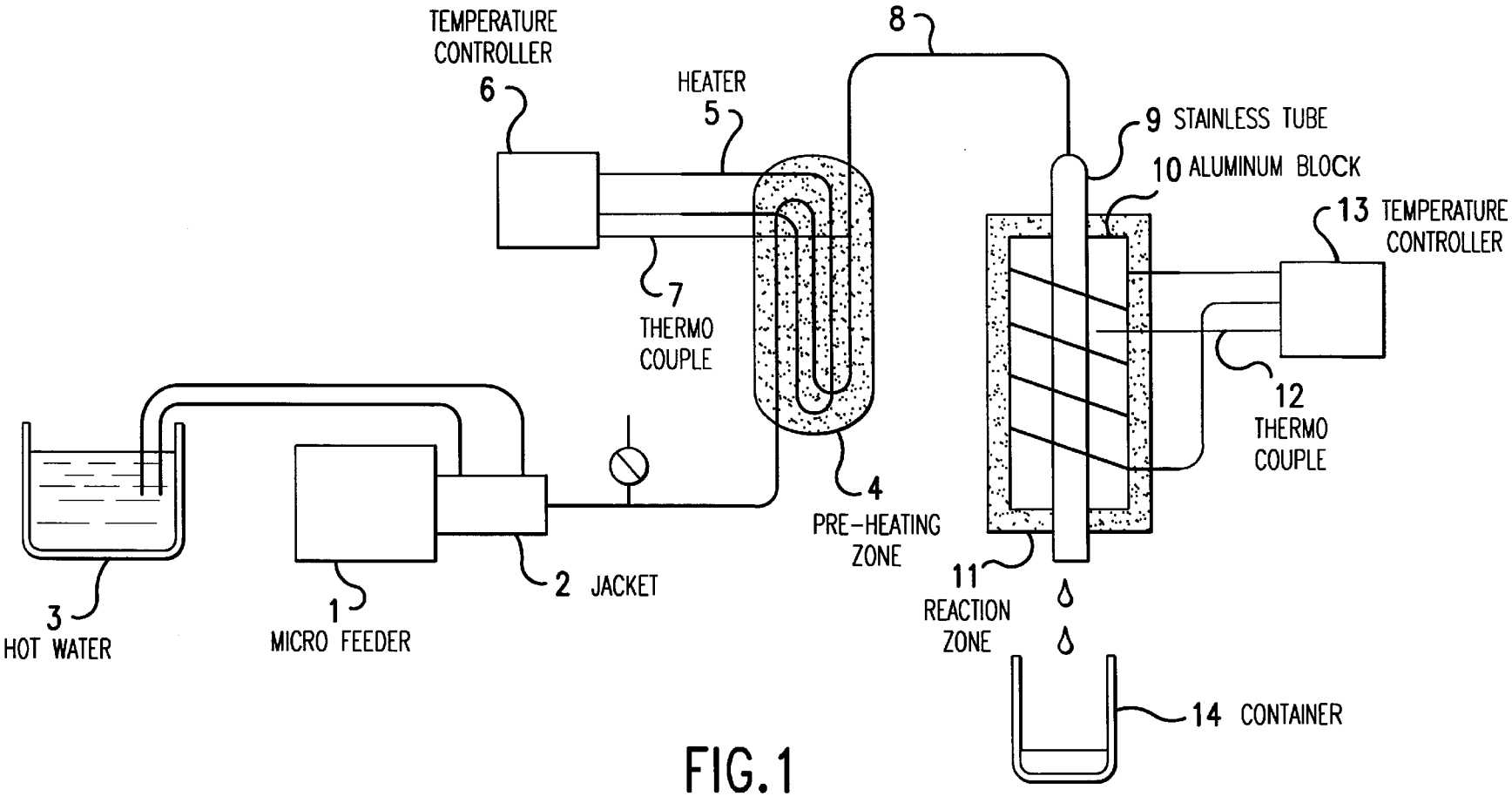
FIG. 1 illustrates a test unit for thermal cracking used in Examples of the present invention.

In examples, residue obtained from the bottom of atmospheric distillation column was heat-treated in a test unit shown in FIG. 1 in the presence or absence of additive according to the present invention to study how the yield of lighter components increase.

As control sample, the residue of atmospheric distillation column was used. In comparative examples, the additive according to the present invention was replaced by other sulfur-containing compounds which were outside the present invention.

Each sample of the residue from atmospheric distillation column containing (or not containing) an additive was injected continuously into the test unit through a micro-feeder 1 which was heated by a jacket 2 through which hot water of 60° C. circulate from a hot water tank 3. The sample was heated in a pre-heating zone 4 covered by insulator and maintained at a temperature of 250° C. by a heater 5 which was controlled by temperature-adjuster 6 and thermocouple 7. The sample was fed through a stainless tube 8 having a diameter of ⅛ inch to a reaction zone 11 in which the stainless tube 8 was enlarged to a ¼ inch tube 9. This stainless tube 9 (length of 30 cm) was embedded in aluminum block 10 (diameter of 6 cm×height of 25 cm). The reaction zone 11 was further surrounded by an insulator and was kept at a temperature of 410° C. by a heater which was controlled by temperature-adjuster 13 and thermocouple 12.

The residence time of the residue from atmospheric distillation column in the reaction zone 11 was adjusted to 10 minutes which corresponds to a condition in actual vacuum distillation column.

Thus, improvement in the yield realized by the additive according to the present invention was evaluated with the residue from atmospheric distillation column in the test unit shown in FIG. 1 which simulates a heating stage in actual oil refinery process.

The same test was carried out for the control sample of the same residue but contains no additive and for comparative examples in which the additive according to the present invention was replaced by sulfur-containing compounds which were outside the present invention.

Example 1

Following compound "A" (a product of Nippon Shokubai Co., Ltd.) having mercapto alkylthio group was used as additive:

$CH_3OCOCH_2CH_2SCH_2CH(CH_3)SH$

The weight concentration of the additive added to the residue of atmospheric distillation column at was adjusted to 200 ppm.

The test was carried out in the test unit shown in FIG. 1 which simulates a heating stage in actual oil refinery process to evaluate improvement in the yield realized by the additive according to the present invention.

In practice, heat-decomposed product form the reaction tube 9 was collected and was analyzed by a distillate analyzer of gas chromatography according to ASTM D 2887 to find the yield of 59.1% for lighter components or cuts having boiling points between 250° C. and 500° C.

The same procedure as above was repeated for the control containing no additive to find the yield of 46.5%.

Comparing the results, it was revealed that the additive improve the yield. In fact, the yield was improved by 12.6% (=59.1−46.5) by the additive according to the present invention.

EXAMPLE 2

The same procedure as Example 1 was repeated but as additive a mixture "B" of following two compound (a) and (b) (products of Nippon Shokubai Co., Ltd.) (weight ratio= 9:1) was used:

(a) $CH_3OCOCH_2SCH_2CH_2SH$ (b) $CH_3OCOCH_2SCH_2CH_2SCH_2CH_2SH$

The yield of lighter components having boiling points between 250° C. and 500° C. was 66.7%.

Thus, the yield was improved by 20.2% (=66.7−46.5) by the additive according to the present invention.

EXAMPLE 3

The same procedure as Example 1 was repeated but as additive a mixture "C" of following two compound (a) and (b) (products of Nippon Shokubai Co., Ltd.) (weight ratio= 9:1) was used:

(a) $CH_3OCOCH_2CH_2SCH_2CH_2SH$ (b) $CH_3)COCH_2CH_2SCH_2CH_2SCH_2CH_2SH$

The yield of lighter components having boiling points between 250° C. and 500° C. was 65.4%.

Thus, the yield was improved by 18.9% (=64.4−46.5) by the additive according to the present invention.

EXAMPLE 4

The same procedure as Example 1 was repeated but as additive a mixture "D" of following two compound (a) and (b) (products of Nippon Shokubai Co., Ltd.) (weight ratio= 9:1) was used:

(a) $CH_3OCOCH_2SCH_2CH(CH_3)SH$ (b) $CH_3OCOCH_2SCH_2CH(CH_3)SCH_2CH(CH_3)SH$

The yield of lighter components having boiling points between 250° C. and 500° C. was 61.2%.

Thus, the yield was improved by 14.7% (=61.2−46.5) by the additive according to the present invention.

COMPARATIVE EXAMPLE 1

The same procedure as Example 1 was repeated but as additive 2-mercapto ethanol:

$HOCH_2CH_2SH$ (product of Elf Atochem S.A.) was used.

The yield of lighter components having boiling points between 250° C. and 500° C. was 48.3%. This reveals that this additive little improves the yield.

COMPARATIVE EXAMPLE 2

The same procedure as Example 1 was repeated but as additive dimethyl sulfide:

$CH_3SCH_3$ (product of Elf Atochem S.A.) was used.

The yield of lighter components having boiling points between 250° C. and 500° C. was 47.8%. This reveals that this additive little improve the yield.

COMPARATIVE EXAMPLE 3

The same procedure as Example 1 was repeated but as additive dimethyl disulfide:

$CH_3SSCH_3$ (product of Elf Atochem S.A.) was used.

The yield of lighter components having boiling points between 250° C. and 500° C. was 45.1%. This means that this additive little improve the yield.

COMPARATIVE EXAMPLE 4

The same procedure as Example 1 was repeated but as additive methyl-3-mercapto propionate:

$CH_3OCOCH_2CH_2SH$ (product of Elf Atochem S.A.) was used.

The yield of lighter components having boiling points between 250° C. and 500° C. was 42.1%. In this case, the yield was decreased by 4.4%.

COMPARATIVE EXAMPLE 5

The same procedure as Example 1 was repeated but as additive pentaerythritol tetrakis(3-mercapto propionate):

$C(CH_2OCOCH_2CH_2SH)_4$ (product of Elf Atochem S.A.) was used.

The yield of lighter components having boiling points between 250° C. and 500° C. was 41.7%. In this case also, the yield was decreased by 4.8%.

The results are summarized in Table 1.

TABLE 1

| | Additive | the yield (%) | increment (%) |
|---|---|---|---|
| control | none | 46.5 | — |
| Example 1 | A* | 59.1 | 12.6 |
| Example 2 | B* | 66.7 | 20.2 |
| Example 3 | C* | 65.4 | 18.9 |
| Example 4 | D* | 61.2 | 14.7 |
| Comparative 1 | $HOCH_2CH_2SH$ | 48.3 | 1.8 |

TABLE 1-continued

| Additive | | the yield (%) | increment (%) |
|---|---|---|---|
| Comparative 2 | $CH_3SCH_3$ | 47.8 | 1.3 |
| Comparative 3 | $CH_3SSCH_3$ | 45.1 | −1.1 |
| Comparative 4 | $CH_3OCOCH_2CH_2SH$ | 42.1 | −4.4 |
| Comparative 5 | $C(CH_2OCOCH_2CH_2SH)_4$ | 41.7 | −4.8 |

*A: $CH_3OCOCH_2CH_2SCH_2CH(CH_3)SH$
*B: a mixture of $CH_3OCOCH_2SCH_2CH_2SH$ $CH_3OCOCH_2SCH_2CH_2SCH_2CH_2SH$ (9:1)
*C: a mixture of $CH_3OCOCH_2CH_2SCH_2CH_2SH$ $CH_3OCOCH_2CH_2SCH_2CH_2SCH_2CH_2SH$ (9:1)
*D: a mixture of $CH_3OCOCH_2SCH_2CH(CH_3)SH$ $CH_3OCOCH_2SCH_2CH(CH_3)SCH_2CH(CH_3)SH$ (9:1)

Table 1 reveals that the compounds (I) having mercaptoalkylthio group according to the present invention exhibit remarkable property to improve the yield of lighter components comparing to other compounds used in Comparative Examples.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. Method for improving the yield of lighter components in heat-refining process of petroleum heavy oil, comprising said heat-treatment in a heating unit being effected in the presence of at least one compound (I) having at least one mercapto alkylthio group:

$$(R_1, R_2, R_3, R_4, R_5, R_6\text{-}(S\text{-}C_mH_{2m}\text{—}SH)_n \quad (A)$$

in which

"m" is an integer of 2 to 4,

"n" is an integer of 1 to 6; and each of $R_1$, $R_2$, $R_3$, $R_4$, $R_5$ and $R_6$ is an organic group and optionally bonded to each other through at least one chemical bond, and at least one of $R_1$, $R_2$, $R_3$, $R_4$, $R_5$ and $R_6$ must exist in said compound, the total carbon number of $R_1$, $R_2$, $R_3$, $R_4$, $R_5$ and $R_6$ being 1 to 28.

2. The method set forth in claim 1, wherein said compound (I) having mercapto alkylthio group is added in a proportion of 10 ppm to 1% by weight with respect to said petroleum heavy oil to be treated.

3. The method set forth in claim 1, wherein said heat-treatment is carried out in a temperature ranging from 250° C. to 550° C. and in a residence time of 1 to 60 min.

4. The method set forth in claim 1, wherein said compound (I) having mercapto alkylthio group is added to said petroleum heavy oil before the latter is introduced into said heating unit.

5. The method set forth in claim 1, wherein said heating unit is thermal cracking unit or visbreaking unit.

6. Method for improving the yield of lighter components in heat-refining process of petroleum heavy oil comprising:

a) adding to petroleum heavy oil a compound (I) having at least one mercaptoalkylthio group:

$$HS\text{—}C_mH_{2m}\text{—}S\text{—}$$

in which "m" is an integer of 2 to 4; and b) heat-treating the petroleum heavy oil containing compound (I) in a heating unit.

* * * * *